US010718238B2

(12) United States Patent
Wenger et al.

(10) Patent No.: US 10,718,238 B2
(45) Date of Patent: Jul. 21, 2020

(54) VARIABLE VALVE TIMING SYSTEM FOR AN ENGINE

(71) Applicant: Indian Motorcycle International, LLC, Medina, MN (US)

(72) Inventors: Urs Wenger, Rumisberg (CH); David A. Galsworthy, Wyoming, MN (US); Brian J. Hitt, Forest Lake, MN (US)

(73) Assignee: Indian Motorcycle International, LLC, Medina, MN (US)

( * ) Notice: Subject to any disclaimer, the term of this patent is extended or adjusted under 35 U.S.C. 154(b) by 0 days.

(21) Appl. No.: 16/174,849

(22) Filed: Oct. 30, 2018

(65) Prior Publication Data

US 2019/0136721 A1 May 9, 2019

Related U.S. Application Data

(60) Provisional application No. 62/581,376, filed on Nov. 3, 2017.

(51) Int. Cl.
*F01L 1/344* (2006.01)
*F01L 1/14* (2006.01)
(Continued)

(52) U.S. Cl.
CPC ..... *F01L 1/344* (2013.01); *F01L 1/047* (2013.01); *F01L 1/146* (2013.01); *F01L 1/3442* (2013.01);
(Continued)

(58) Field of Classification Search
CPC ..... F01L 1/022; F01L 1/026; F01L 2001/054; F01L 1/146; F01L 1/344;
(Continued)

(56) References Cited

U.S. PATENT DOCUMENTS 1,654,366 A 1/1925 Fredden
2,880,711 A 4/1959 Roan
(Continued)

FOREIGN PATENT DOCUMENTS

AT 516570 6/2016
AU 2013201996 10/2013
(Continued)

OTHER PUBLICATIONS

International Search Report issued by the International Searching Authority, dated Feb. 26, 2019, for International Patent Application No. PCT/US2018/058074; 6 pages.
(Continued)

*Primary Examiner* — Jorge L Leon, Jr.
(74) *Attorney, Agent, or Firm* — Faegre Drinker Biddle & Reath LLP

(57) ABSTRACT

An engine for a two-wheeled vehicle includes at least one cylinder comprising a combustion chamber and a cylinder head positioned adjacent the combustion chamber. The engine further includes a crankcase coupled to the at least one cylinder which includes a crankshaft. Additionally, the engine includes a valve train operably coupled to the crankshaft which includes at least one intake valve fluidly coupled to the combustion chamber, at least one exhaust valve fluidly coupled to the combustion chamber, at least one pushrod operably coupled to at least one of the intake valve and the exhaust valve, at least one camshaft operably coupled to the at least one pushrod and the crankshaft, and a cam phaser assembly operably coupled to the at least one camshaft and positioned generally outside an envelope of the cylinder head.

25 Claims, 10 Drawing Sheets

(51) Int. Cl.

| | |
|---|---|
| ***F01L 1/047*** | (2006.01) |
| ***F02B 61/02*** | (2006.01) |
| *F02B 75/22* | (2006.01) |
| *F02B 75/18* | (2006.01) |

(52) U.S. Cl.

CPC ..... *F01L 1/34409* (2013.01); *F02B 61/02* (2013.01); *F01L 2001/054* (2013.01); *F01L 2820/041* (2013.01); *F02B 75/22* (2013.01); *F02B 2075/1808* (2013.01)

(58) Field of Classification Search

CPC ..... F01L 2001/34486; F01L 1/46; F01L 2013/111; F01L 2250/02; F01L 2250/06; F01L 2800/14; F01L 2820/041; F02B 2075/1808; F02B 75/22

USPC ..... 123/90.15, 90.16, 90.17, 90.23, 90.31, 123/90.61

See application file for complete search history.

(56) References Cited

U.S. PATENT DOCUMENTS

| | | | | |
|---|---|---|---|---|
| 4,084,557 | A | 4/1978 | Luria | |
| 4,955,330 | A | 9/1990 | Fabi | |
| 5,327,859 | A | 7/1994 | Pierik | |
| 5,351,662 | A | 10/1994 | Dopson | |
| 5,560,329 | A * | 10/1996 | Hayman | F01L 1/34 123/54.4 |
| 5,752,866 | A | 5/1998 | Takahashi | |
| 6,047,667 | A | 4/2000 | Leppanen | |
| 6,189,498 | B1 * | 2/2001 | Yonezawa | F01L 1/02 123/90.15 |
| 7,252,054 | B2 | 8/2007 | Weber | |
| 7,380,531 | B2 | 6/2008 | Haefner | |
| 7,404,386 | B1 | 7/2008 | Raghavan | |
| 7,441,523 | B2 | 10/2008 | Kido | |
| 7,454,961 | B2 | 11/2008 | Pirone | |
| 7,527,028 | B2 | 5/2009 | Leone | |
| 7,603,973 | B2 | 10/2009 | Flier | |
| 7,703,423 | B2 | 4/2010 | Burgess | |
| 7,765,966 | B2 | 8/2010 | Leone | |
| 7,802,547 | B2 | 9/2010 | Inomoto | |
| 8,011,333 | B2 | 9/2011 | Burgess | |
| 8,069,829 | B2 | 12/2011 | Leone | |
| 8,360,018 | B2 | 1/2013 | Sato | |
| 8,375,905 | B2 | 2/2013 | Sato | |
| 8,511,273 | B2 | 8/2013 | Burgess | |
| 8,528,389 | B2 | 9/2013 | Sato | |
| 8,794,204 | B2 | 8/2014 | Hayman | |
| 8,820,284 | B2 | 9/2014 | Mori | |
| D716,702 | S | 11/2014 | Song | |
| 8,919,311 | B2 | 12/2014 | Flynn | |
| D722,538 | S | 2/2015 | Song | |
| 8,967,103 | B2 | 3/2015 | Tanis | |
| 9,121,358 | B2 | 9/2015 | Strehlau | |
| 9,381,803 | B2 | 7/2016 | Galsworthy | |
| 9,421,860 | B2 | 8/2016 | Schuhmacher | |
| 9,908,577 | B2 | 3/2018 | Novak | |
| 10,221,727 | B1 | 3/2019 | Walter | |
| 2003/0154711 | A1 * | 8/2003 | Hayman | F01L 1/02 60/284 |
| 2005/0066932 | A1 * | 3/2005 | Patterson | F02D 17/02 123/198 F |
| 2005/0279302 | A1 * | 12/2005 | Lancefield | F01L 1/024 123/90.15 |
| 2006/0086330 | A1 | 4/2006 | Harmon | |
| 2007/0074687 | A1 | 4/2007 | Bosl-Flierl | |
| 2007/0163336 | A1 | 7/2007 | Pirone | |
| 2007/0209618 | A1 | 9/2007 | Leone | |
| 2007/0266971 | A1 | 11/2007 | Bosl-Flierl | |
| 2008/0035083 | A1 | 2/2008 | Inomoto | |
| 2008/0251045 | A1 | 10/2008 | Pass | |
| 2008/0302318 | A1 | 12/2008 | Pattakos | |
| 2009/0223469 | A1 * | 9/2009 | Rozario | F01L 1/024 123/90.17 |
| 2009/0241869 | A1 * | 10/2009 | Burgess | F01L 1/024 123/54.4 |
| 2010/0242871 | A1 | 9/2010 | Sato | |
| 2010/0269773 | A1 | 10/2010 | Hayman | |
| 2011/0073054 | A1 * | 3/2011 | Metcalf | F01L 1/047 123/90.17 |
| 2011/0265745 | A1 | 11/2011 | Burgess | |
| 2014/0251246 | A1 | 9/2014 | Flynn | |
| 2014/0261264 | A1 * | 9/2014 | Rotter | F01L 1/146 123/90.16 |
| 2016/0146073 | A1 | 5/2016 | Hillebrecht | |
| 2016/0265398 | A1 * | 9/2016 | Koyama | F01L 1/146 |
| 2016/0280324 | A1 | 9/2016 | Schafer | |
| 2016/0318569 | A1 | 11/2016 | Zellmer | |
| 2018/0045088 | A1 * | 2/2018 | Urushihata | F01L 1/352 |
| 2018/0162474 | A1 | 6/2018 | Novak | |

FOREIGN PATENT DOCUMENTS

| | | |
|---|---|---|
| CN | 101046166 | 10/2007 |
| CN | 101122246 | 2/2008 |
| CN | 201065775 | 5/2008 |
| CN | 103362588 | 10/2013 |
| CN | 204239000 | 4/2015 |
| CN | 105649707 | 6/2016 |
| CN | 103061844 | 11/2016 |
| DE | 102016201913 A1 | 10/2016 |
| EA | 201490349 | 9/2014 |
| EP | 1674672 | 6/2006 |
| EP | 2917094 | 9/2015 |
| EP | 3023608 | 5/2016 |
| EP | 3051080 | 8/2016 |
| EP | 3073070 | 9/2016 |
| EP | 3073071 | 9/2016 |
| JP | 2002180812 | 6/2002 |
| JP | 2003343381 | 12/2003 |
| JP | 2005180316 | 7/2005 |
| JP | 2007262980 | 10/2007 |
| JP | 2010159718 | 7/2010 |
| JP | 2010229948 | 10/2010 |
| JP | 04696273 | 6/2011 |
| JP | 05428976 | 10/2011 |
| JP | 2011202625 | 10/2011 |
| JP | 05149268 | 2/2013 |
| JP | 05277156 | 8/2013 |
| JP | 2013209971 | 10/2013 |
| JP | 05385658 | 1/2014 |
| JP | 05571997 | 8/2014 |
| JP | 2014224491 | 12/2014 |
| JP | 2015183639 | 10/2015 |
| JP | 05909322 | 4/2016 |
| JP | 05916484 | 5/2016 |
| JP | 2016098832 | 5/2016 |
| JP | 06005382 | 10/2016 |
| KR | 2016060581 | 5/2016 |
| WO | WO 1995/009298 | 4/1995 |
| WO | WO 2000/009868 | 2/2000 |
| WO | WO 2004/088094 | 10/2004 |
| WO | WO 2004/088099 | 10/2004 |
| WO | WO 2006/083350 | 8/2006 |
| WO | WO 2009/049996 | 4/2009 |
| WO | WO 2014/075091 | 5/2014 |

OTHER PUBLICATIONS

Written Opinion of the International Searching Authority, dated Feb. 26, 2019, for International Patent Application No. PCT/US2018/058074; 10 pages.

Andy Cherney: "Indian's Big Reveal: The New Thunder Stroke 111 Engine Indian Motorcycle Unveils Mill That Will Power New 2014 models", Mar. 11, 2013, https://www.motorcyclecruiser.com/indians-big-revewal-new-thunder-stroke-111-engine; 3 pages.

"Balls of steel", Suzuki GSX-R1000, article; 2 pages, last accessed Feb. 28, 2017.

(56) References Cited

OTHER PUBLICATIONS

Suzuki GSF400V Bandit had VVT, vehicle available in 1991, available at http://www.suzukicycles.org/Bandit-series/GSF400-Bandit.shtml; 6 pages.
Honda CBR400F had VVT, vehicle available in 1983, available at https://www.motorcyclespecs.co.za/model/Honda/honda_cbr400f%2083.htm; 3 pages.
Honda VTEC Dual Overhead Cam Images, vehicle available in 1989, available at https://world.honda.com/history/challenge/1989vtecengine/index.html; 3 pages.
2018 Yamaha Venture motorcycle images of engine, Jordan Mastagni, dated Aug. 25, 2017, available at https://www.motorcyclecruiser.com/2018-yamaha-star-venture-first-ride-review; 5 pages.
Harley 107 and 114, Milwaukee 8 images of engine, available in 2017, available at https://www.avalancheharley.com/harley-davidson-announces-107ci-and-114ci-engine/; 6 pages.
Laser Engines available at https://web.archive.org/web/20030921043100/http://laserengines.com:80/, available at least as early as Sep. 21, 2003; 3 pages.
"One Owner 1955 Vincent Black Shadow Auction," Bryan Harley, dated Aug. 3, 2012, available at http://www.motorcycle-usa.com/one-owner-1955-vincent-black-shadow-auction/; 8 pages.
International Preliminary Report on Patentability issued by the International Preliminary Examining Authority, dated Feb. 10, 2020, for International Patent Application No. PCT/US2018/058074; 19 pages.
Second Written Opinion of the International Preliminary Examining Authority, dated Dec. 11, 2019, for International Patent Application No. PCT/US2018/058074; 8 pages.

* cited by examiner

VARIABLE VALVE TIMING SYSTEM FOR AN ENGINE

RELATED CASES

This application claims priority to U.S. Provisional Patent Application Ser. No. 62/581,376, filed Nov. 3, 2017, the complete disclosure of which is expressly incorporated herein by reference.

BACKGROUND OF THE DISCLOSURE

The present disclosure relates to an engine for a vehicle, such as a two-wheeled vehicle, and, more particularly, to an engine configured with variable valve timing for a motorcycle.

Conventional engines may be tuned and designed for various applications. For example, in one application, an engine may be tuned and designed for high-speed and high-horsepower performance, while in another application, an engine may be tuned and designed for fuel efficiency and lower emissions output. Such differences between these performance parameters of the engine may be at least partially controlled through the opening and closing timing of the intake and exhaust valves. The valve timing for opening and closing the intake and exhaust valves may be fixed, such that the intake and/or exhaust valves open at only one predetermined time and close at only one predetermined time, regardless of the performance parameters of the engine. However, depending on the vehicle, type of terrain, and other driving conditions, it may be desirable to vary the valve timing to allow opening and closing of the intake and exhaust valves at different crank angle position.

Various engines may use control devices which provide the ability to vary at least some parameters of the intake and/or exhaust valves. However, the location of such control devices may interfere with other engine or powertrain components and/or the user's ability to comfortably sit on and use the vehicle. For example, on a motorcycle, the user straddles the engine and any control device coupled to the engine for controlling the valve timing must be positioned at a location that does not interfere with operation of other engine components or the user's ability to use the foot controls and/or floorboard.

In this way, there is a need for a motorcycle engine configured with a variable valve timing system which is able to control the timing, duration, and amount of opening of the intake and/or exhaust valves.

SUMMARY OF THE DISCLOSURE

In an illustrative embodiment of the present disclosure, an engine for a two-wheeled vehicle comprises at least one cylinder comprising a combustion chamber and a cylinder head positioned adjacent the combustion chamber. The engine also comprises a crankcase coupled to the at least one cylinder which includes a crankshaft. Additionally, the engine comprises a piston positioned within the at least one cylinder and operably coupled to the crankshaft. The engine further comprises a valve train operably coupled to the crankshaft which comprises at least one intake valve fluidly coupled to the combustion chamber, at least one exhaust valve fluidly coupled to the combustion chamber, at least one pushrod operably coupled to at least one of the intake valve or the exhaust valve, at least one camshaft operably coupled to the at least one pushrod and the crankshaft, and a cam phaser assembly operably coupled to the at least one camshaft and positioned generally outside an envelope of the cylinder head.

A further illustrative embodiment of the present disclosure includes an engine for a two-wheeled vehicle comprising at least one cylinder having a combustion chamber and a cylinder head positioned adjacent the combustion chamber. The engine also comprises a crankcase coupled to the at least one cylinder which includes a crankshaft. Additionally, the engine comprises a valve train operably coupled to the crankshaft and which comprises at least one intake valve fluidly coupled to the combustion chamber, at least one exhaust valve fluidly coupled to the combustion chamber, at least one pushrod operably coupled to at least one of the intake valve or the exhaust valve, a cam chest operably coupled to the at least one pushrod, and a cam phaser assembly operably coupled to the cam chest. The cam chest and the cam phaser assembly are positioned outward of the crankcase and the at least one cylinder in a top view of the engine.

Another illustrative embodiment of the present disclosure includes an engine for a two-wheeled vehicle comprising at least one cylinder having a combustion chamber and a cylinder head positioned adjacent the combustion chamber. The engine also comprises a crankcase coupled to the at least one cylinder which includes a crankshaft. Additionally, the engine comprises a valve train operably coupled to the crankshaft which comprises at least one camshaft operably coupled to the crankshaft and vertically overlapping a portion of the crankshaft in an axial direction. The valve train further comprises a cam phaser assembly operably coupled to the at least one camshaft and positioned outward of the crankcase.

In yet another illustrative embodiment of the present disclosure, an engine for a two-wheeled vehicle comprises a first cylinder having a first piston configured to reciprocate therein along a first axis between a top-dead-center position and a bottom-dead-center position. The top-dead-center position defines a first firing plane of the first piston. The engine also comprises a second cylinder spaced apart from the first cylinder and having a second piston configured to reciprocate therein along a second axis between a top-dead-center position and a bottom-dead-center position. The top-dead-center position of the second piston defines a second firing plane of the second piston. The engine further comprises a crankcase coupled to the first and second cylinders, and the crankcase includes a crankshaft, and the crankshaft is configured to rotate about an axis of rotation. Also, the engine comprises a valve train operably coupled to the crankshaft which includes at least one camshaft operably coupled to the crankshaft and a cam phaser assembly operably coupled to the at least one camshaft. The at least one camshaft and the cam phaser assembly are positioned within an envelope defined by the first and second firing planes and the first and second axes.

The above mentioned and other features of the disclosure, and the manner of attaining them, will become more apparent and the invention itself will be better understood by reference to the following description of embodiments of the invention taken in conjunction with the accompanying drawings.

BRIEF DESCRIPTION OF THE DRAWINGS

Corresponding reference characters indicate corresponding parts throughout the several views. Unless stated otherwise the drawings are proportional.

DETAILED DESCRIPTION OF THE DRAWINGS

The embodiments disclosed below are not intended to be exhaustive or to limit the invention to the precise forms disclosed in the following detailed description. Rather, the embodiments are chosen and described so that others skilled in the art may utilize their teachings. While the present invention primarily involves a motorcycle, it should be understood, that the invention may have application to other types of vehicles such as all-terrain vehicles, other types of two- and three-wheeled vehicles, watercraft, utility vehicles, scooters, golf carts, and mopeds.

The present application relates to an engine, illustratively an engine for a two-wheeled vehicle such as a motorcycle, additional details of which may be disclosed in U.S. Provisional Patent Application Ser. No. 61/725,440, filed Nov. 12, 2012, and entitled "TWO-WHEELED VEHICLE" and U.S. Provisional Patent Application Ser. No. 61/773,708, filed Mar. 6, 2013, and entitled "TWO-WHEELED VEHICLE", the complete disclosures of which are expressly incorporated by reference herein.

Figure 1:
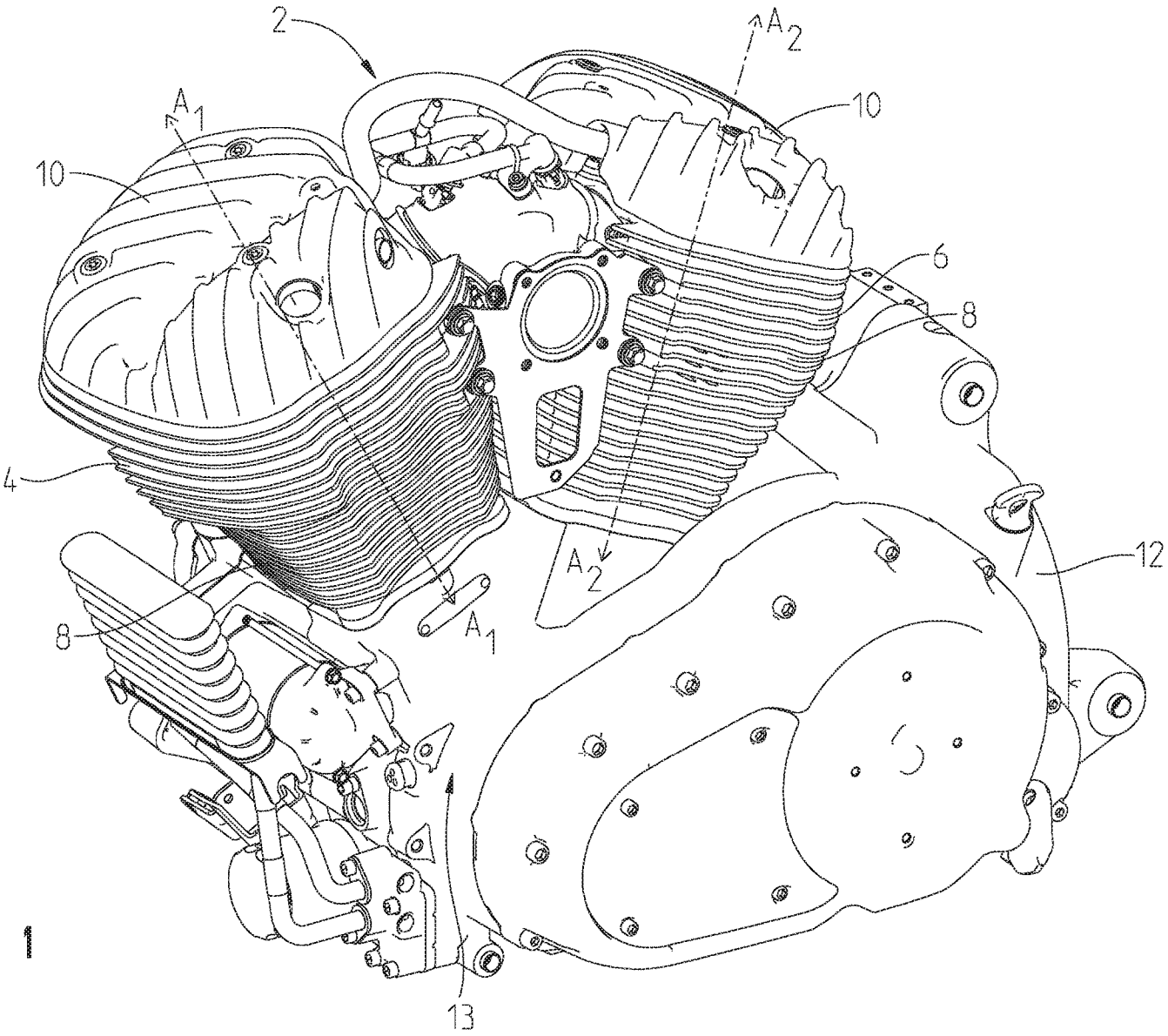
FIG. 1 is a left front perspective view of an engine for a vehicle.
Figure 2:
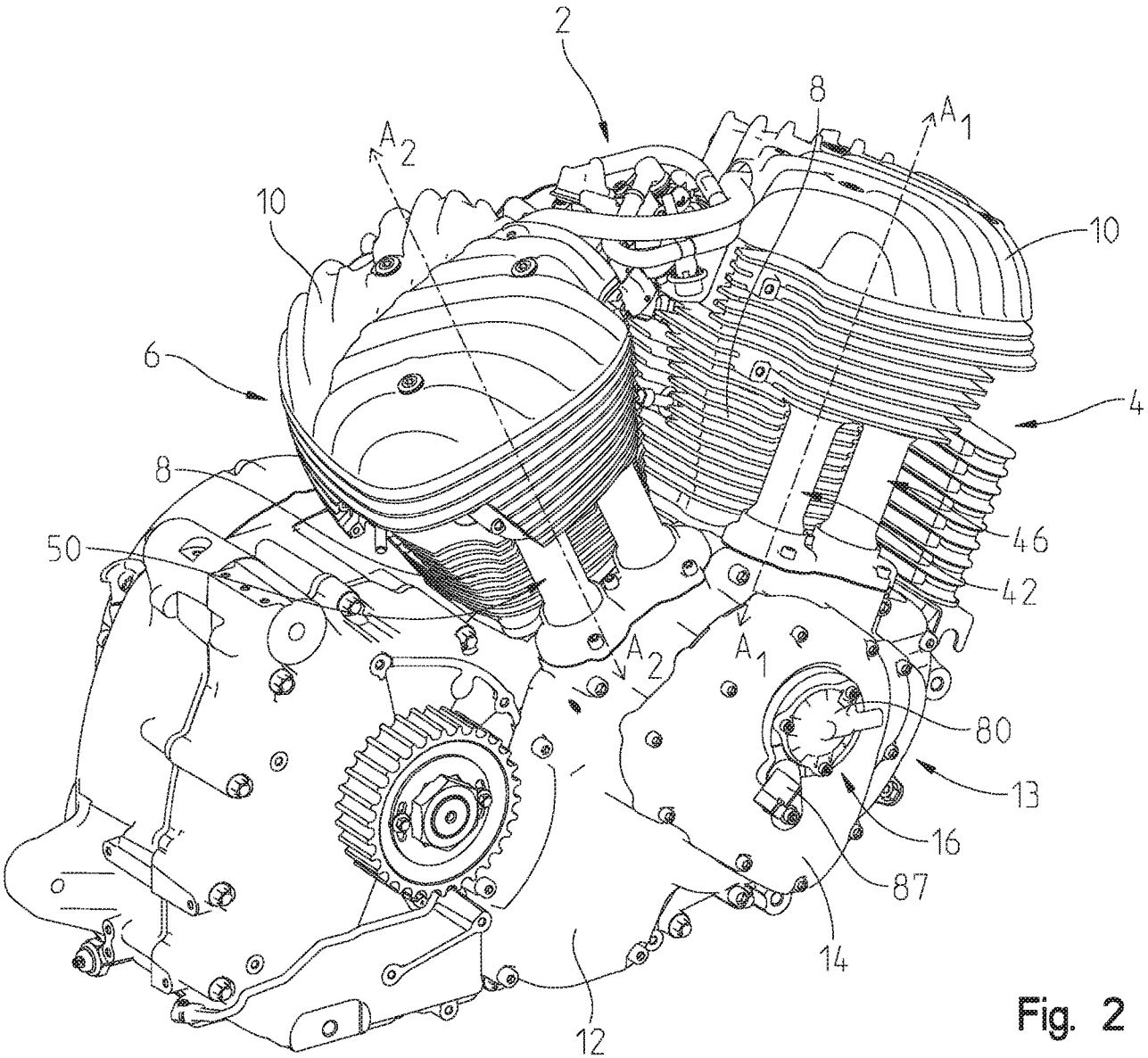
FIG. 2 is a right rear perspective view of the engine of FIG. 1.
Figure 3:
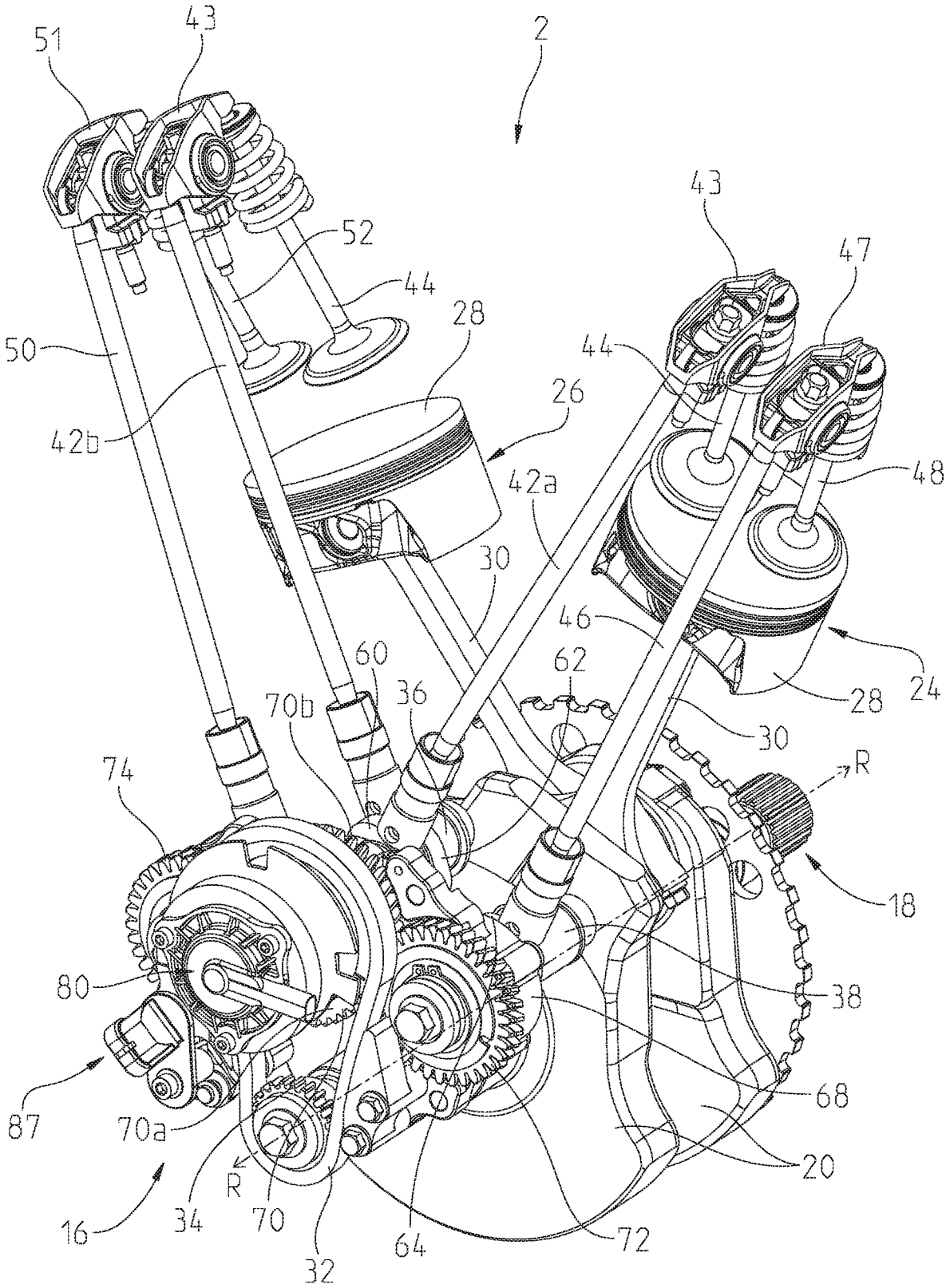
FIG. 3 is a right front perspective view of a valve train and crankshaft of the engine of FIG. 1.
Figure 4:
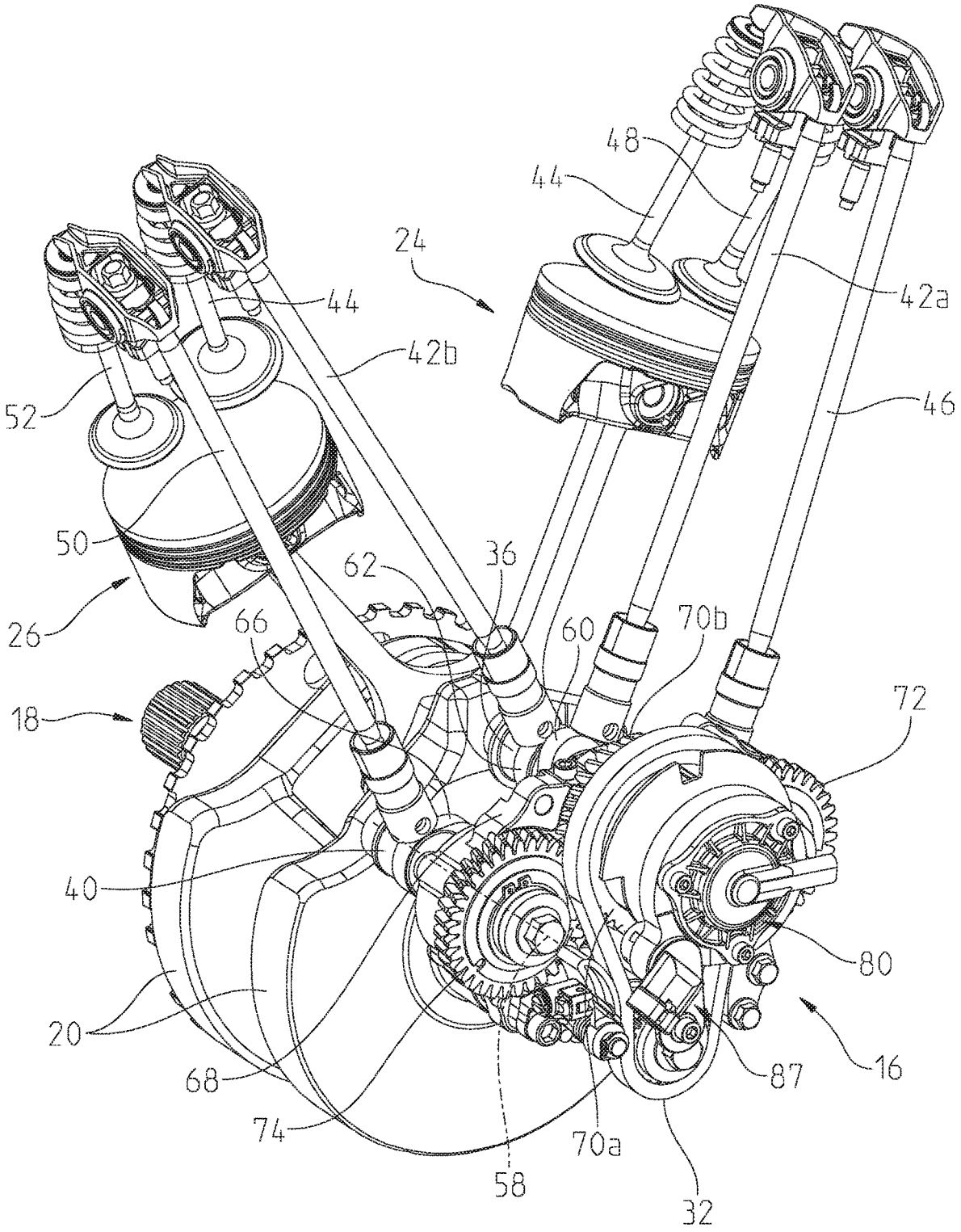
FIG. 4 is a right rear perspective view of the valve train and crankshaft of FIG. 3.

Referring to FIGS. 1 and 2, an engine 2 for a vehicle, for example a motorcycle, is shown. In one embodiment, engine 2 is an approximately V-twin spark-ignition gasoline engine available from Polaris Industries, Inc. located at 2100 Highway 55 in Medina, Minn. 55340. Engine 2 may be operably coupled to a transmission assembly (not shown), for example a six speed overdrive constant mesh transmission, via a belt (e.g., a carbon fiber reinforced belt) available from Polaris Industries, Inc. In alternative embodiments, engine 2 may be operably coupled to a continuous variable transmission.

Still referring to FIGS. 1 and 2, engine 2 includes a first cylinder 4 extending along a first axis $A_1$ and a second cylinder 6 extending along a second axis $A_2$, which, illustratively, is angled relative to first axis $A_1$. First cylinder 4 may define a front cylinder and second cylinder 6 may define a rear cylinder when engine 2 is configured for a motorcycle. First cylinder 4 and second cylinder 6 each includes a cylinder body 8 and a cylinder head 10. Cylinder heads 10 are positioned above cylinder body 8 and a combustion chamber positioned therein. In one embodiment, cylinder heads 10 are positioned adjacent cylinder body 8, and illustratively are vertically above cylinder body 8 and the corresponding combustion chamber positioned therein in a direction perpendicular to a horizontal, longitudinal axis of the vehicle. Cylinder heads 10 also may be positioned vertically above cylinder body 8 and a corresponding combustion chamber along axes $A_1$, $A_2$ such that cylinder heads 10 are angled relative to vertical and horizontal when engine 2 defines a V-twin engine. In this way, cylinder heads 10 are positioned vertically above cylinder bodies 8 in any direction having a vertical component. As shown best in FIG. 2, first and second cylinders 4, 6 are coupled to a crankcase 12, which also may include or be coupled to a transmission housing. Crankcase 12 may be further coupled to a cam chest 14 housing at least a portion of a valve train assembly 16. It may be appreciated that engine 2 may be oriented in any direction but the general relationship of the engine components relative to each other remains unchanged.

Referring to FIGS. 3-7, crankcase 12 supports a crankshaft 18 which is configured to rotate about an axis of rotation R. Illustratively, crankcase 12 includes a crankshaft housing portion 13 configured to support crankshaft 18. A plurality of counterweights 20 are coupled to crankshaft 18 and are configured to rotate with crankshaft 18. More particularly, crankshaft 18 and counterweights 20 define a rotational circular envelope 22 (FIG. 5) as crankshaft 18 and counterweights 20 rotate about axis of rotation R. In other words, the circular rotational path of crankshaft 18 and counterweights 20 defines rotational circular envelope 22.

Crankshaft 18 is driven by a first piston 24 positioned within first cylinder 4 and a second piston 26 positioned within second cylinder 6. First and second pistons 24, 26 are configured to reciprocate or translate between a top-dead-center ("TDC") position and a bottom-dead-center ("BDC") position during operation of engine 2. The reciprocation of pistons 24, 26 within cylinders 4, 6 provides the movement necessary to rotate crankshaft 18. Each of pistons 24, 26 includes a piston head 28 and a connecting rod 30. Cylinders 4, 6 may be configured to accommodate various sizes of pistons 24, 26.

Referring still to FIGS. 3-7, crankshaft 18 is operably coupled to valve train assembly 16. Illustratively, crankshaft 18 is configured to drive rotation of at least a portion of valve train assembly 16 through a chain (e.g., a silent chain) 32, although a belt or other drive mechanism may be used. In one embodiment, a drive sprocket 34 is coupled to an outer portion of crankshaft 18 and rotates with crankshaft 18. Drive sprocket 34 is meshed or otherwise engaged with chain 32 to cause rotation of chain 32. Chain 32 also meshes or engages with portions of valve train assembly 16, as disclosed further herein, such that rotation of chain 32 drives the operation of various components of valve train assembly 16.

As shown in FIGS. 3-7, valve train assembly 16 includes a three-cam pushrod configuration, defined by an intake camshaft 36, a first exhaust camshaft 38 associated with first cylinder 4, and a second exhaust camshaft 40 associated with second cylinder 6. Intake camshaft 36 is positioned vertically above a portion of crankshaft 18 and vertically overlaps such portion of crankshaft 18 in the axial direction of axis of rotation R. However, because intake camshaft 36 is positioned vertically above crankshaft 18, intake camshaft 36 is not axially aligned or collinear with crankshaft 18. Illustratively, none of camshafts 36, 38, 40 are axially aligned or collinear with crankshaft 18.

Intake camshaft 36 is operably coupled to intake pushrods 42, illustratively a first intake pushrod 42*a* operably coupled to first cylinder 4 and a second intake pushrod 42*b* operably coupled to second cylinder 6. In this way, engine 2 includes only a single intake camshaft 36 configured to operate both intake pushrods 42. Intake pushrods 42 are operably coupled to rocker arms 43, the combination of which is configured to move intake valves 44 between a plurality of open and closed conditions at various times during a combustion cycle for engine 2. In one embodiment, rocker arms 43 and intake valves 44 are supported within a portion of cylinder heads 10 (FIG. 1) and intake valves 44 open and close based on the movement of pistons 24, 26 and the rotational position of crankshaft 18.

Figure 10:
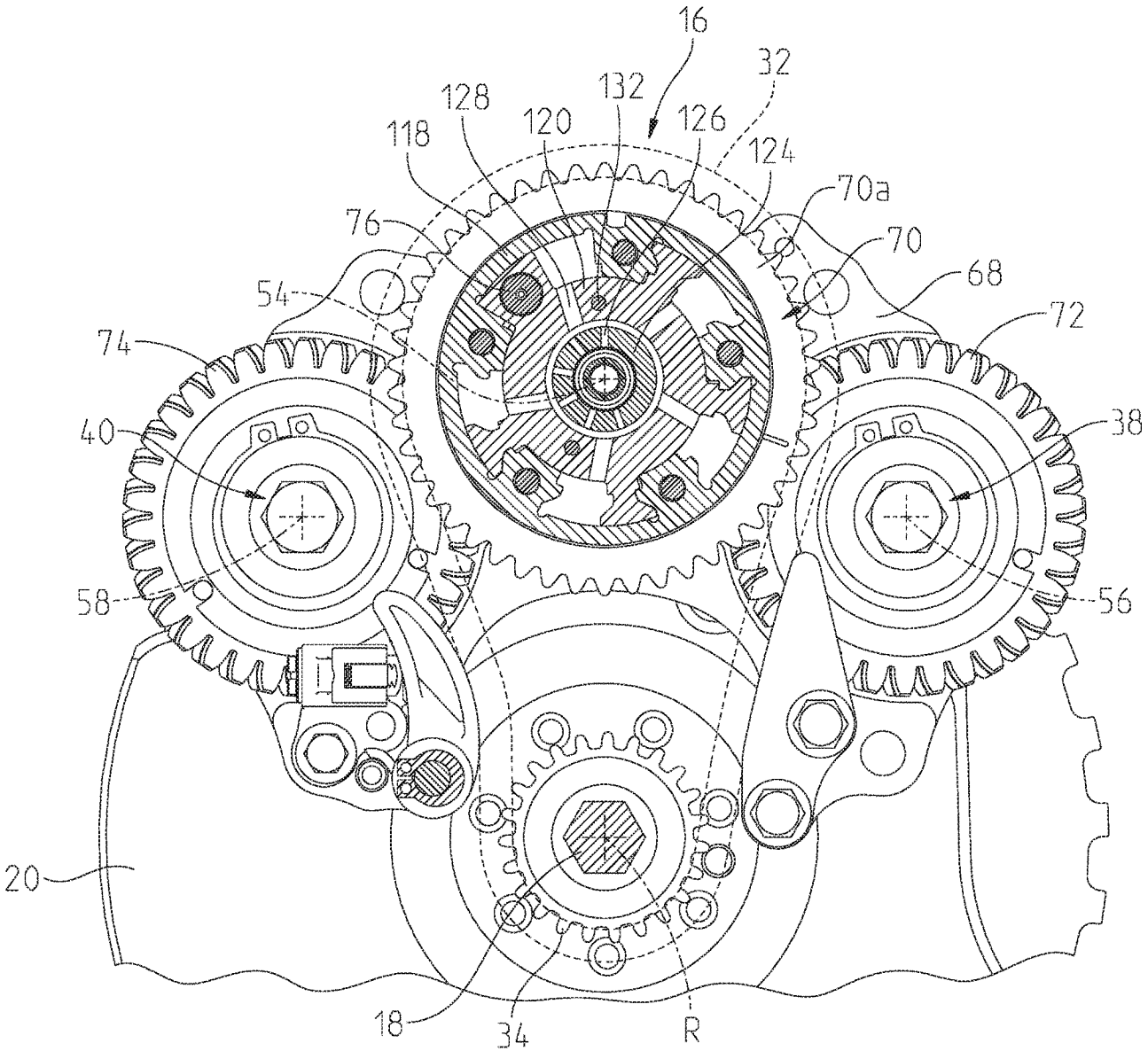
FIG. 10 is a cross-sectional view of a portion of the valve train assembly of FIG. 3, taken along line 10-10 of FIG. 7.

More particularly, intake pushrods 42 are configured to reciprocate in a generally vertical direction with rotation of intake camshaft 36 about a rotational axis 54 (FIG. 10). The rotation of intake camshaft 36 causes linear movement of intake pushrods 42, thereby moving intake valves 44 between open and closed conditions. Illustratively, intake camshaft 36 includes a first lobe 60 and a second lobe 62, both of which are configured to rotate about rotational axis 54 with camshaft 36. The movement of first lobe 60 causes the generally linear and vertical movement of first intake pushrod 42*a* and the movement of second lobe 62 causes the generally linear and vertical movement of second intake pushrod 42*b*.

First exhaust camshaft 38 is operably coupled to a first exhaust pushrod 46 which is configured to open and close a first exhaust valve 48 associated with first cylinder 4 through a rocker arm 47. In one embodiment, rocker arm 47 and first exhaust valve 48 are supported within a portion of cylinder head 10 of first cylinder 4 (FIG. 1) and first exhaust valve 48 moves between a plurality of open and closed conditions based on the movement of piston 24 and the rotational position of crankshaft 18.

More particularly, first exhaust pushrod 46 is configured to reciprocate in a generally vertical direction with rotation of first exhaust camshaft 38 about a rotational axis 56 (FIG. 5), thereby moving first exhaust valve 48 between open and closed conditions. Illustratively, first exhaust camshaft 38 includes a lobe 64 which is configured to rotate about rotational axis 56 with camshaft 38. The movement of lobe 64 causes the generally vertical movement of first exhaust pushrod 46. First exhaust camshaft 38 may be located vertically intermediate intake camshaft 36 and crankshaft 18 but is longitudinally offset from both intake camshaft 36 and crankshaft 18. As such, rotational axis 56 of first exhaust camshaft 38 may be positioned vertically intermediate axis of rotation R of crankshaft 18 and rotational axis 54 of intake camshaft 36.

Second exhaust camshaft 40 is operably coupled to a second exhaust pushrod 50 which is configured to open and close a second exhaust valve 52 associated with second cylinder 6 through a rocker arm 51. In one embodiment, rocker arm 51 and second exhaust valve 52 are supported within a portion of cylinder head 10 of second cylinder 6 (FIG. 1) and second exhaust valve 52 moves between a plurality of open and closed conditions based on the movement of second piston 26 and the rotational position of crankshaft 18.

More particularly, second exhaust pushrod 50 is configured to reciprocate in a generally vertical direction with rotation of second exhaust camshaft 40 about a rotational axis 58 (FIG. 5), thereby moving second exhaust valve 52 between open and closed conditions. Illustratively, second exhaust camshaft 40 includes a lobe 66 which is configured to rotate about rotational axis 58 with camshaft 40. The movement of lobe 66 causes the generally vertical movement of second exhaust pushrod 50. Second exhaust camshaft 40 may be located vertically intermediate intake camshaft 36 and crankshaft 18 but is longitudinally offset from both intake camshaft 36 and crankshaft 18. As such, rotational axis 58 of second exhaust camshaft 40 may be positioned vertically intermediate axis of rotation R of crankshaft 18 and rotational axis 54 of intake camshaft 36.

Referring still to FIGS. 3-7, camshafts 36, 38, 40 are supported on crankcase 12 by cam chest 14 (FIG. 2) which includes a cam carrier plate 68. In one embodiment, cam chest 14 may be formed by a portion of crankcase 12 outside of crankcase housing 13, whereas in another embodiment, cam chest 14 may be coupled to an outer surface of crankcase 12. Cam carrier plate 68 supports outer portions of camshafts 36, 38, 40 at a position laterally outward of crankcase 12. In one embodiment, camshafts 36, 38, 40 are positioned vertically lower than cylinders 4, 6. Cam carrier plate 68 further supports a plurality of sprockets of valve train assembly 16. Illustratively, intake camshaft 36 is coupled to and/or includes an intake cam drive assembly 70, first exhaust camshaft 38 is coupled to and/or includes a first exhaust cam sprocket 72, and second exhaust camshaft 40 is coupled to and/or includes a second exhaust cam sprocket 74. Rotation of drive assembly 70 and sprockets 72, 74 causes rotation of camshafts 36, 38, 40 for operating pushrods 42, 46, 50, respectively, as disclosed herein.

Figure 9:
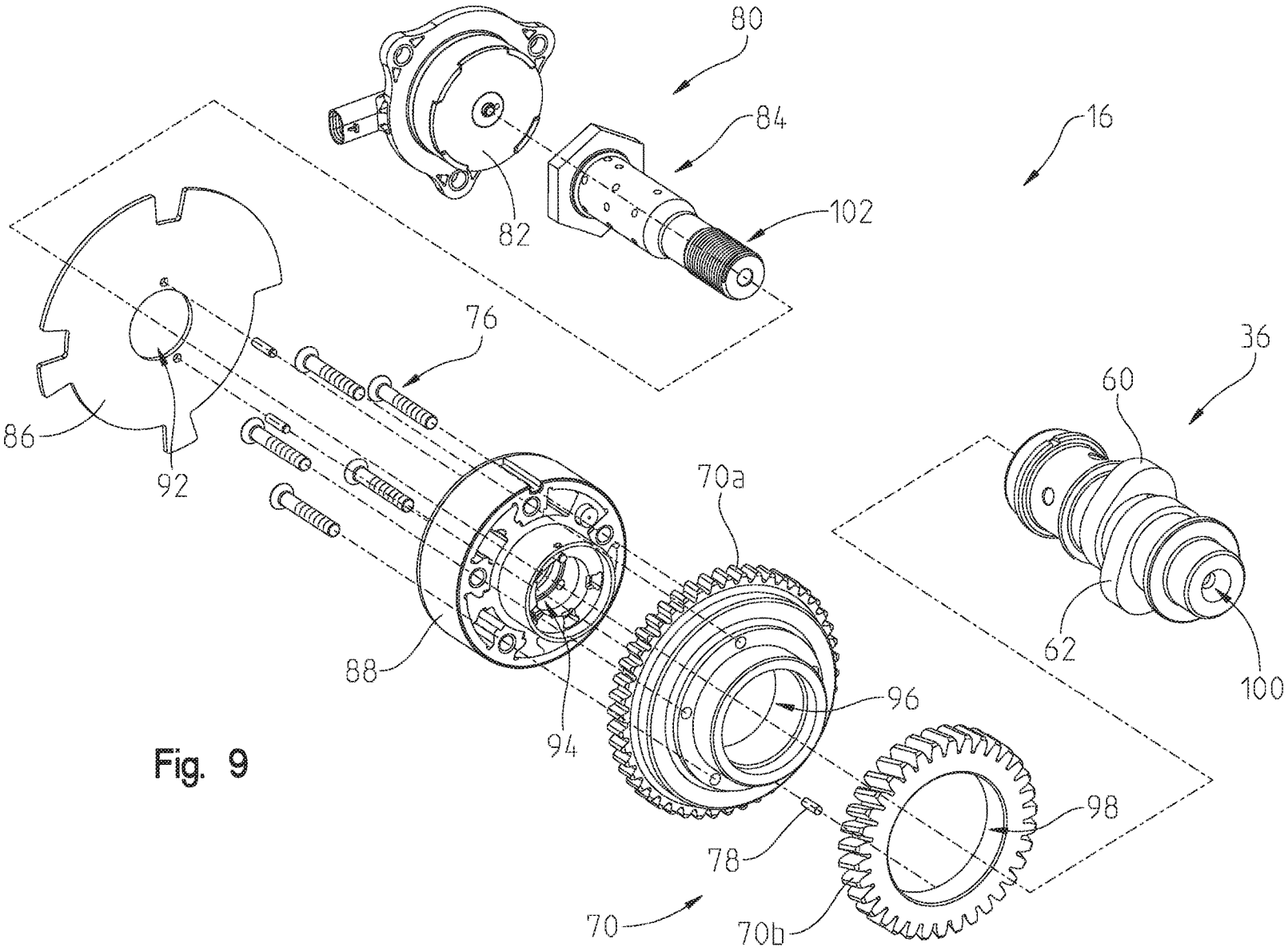
FIG. 9 is a rear exploded view of the cam phaser assembly of FIG. 8.

Intake cam drive assembly 70 is rotationally coupled to drive sprocket 34 on crankshaft 18 through chain 32. More particularly, intake cam drive assembly 70 includes a sprocket 70*a* and a gear 70*b* positioned laterally inward of sprocket 70*a*. Gear 70*b* may be located on sprocket 70*a* with a dowel 78, as shown in FIG. 9, such that sprocket 70*a* and gear 70*b* are fixed together. Sprocket 70*a* and gear 70*b* are configured to rotate together in response to drive sprocket 34, however, the lateral offset of sprocket 70*a* and gear 70*b* allows for intake cam drive assembly 70 to engage multiple components of engine 2. For example, chain 32 meshes with or otherwise engages with sprocket 70*a* of intake cam drive assembly 70 such that rotation of crankshaft 18 drives rotation of intake cam drive assembly 70, thereby causing rotation of intake camshaft 36. However, due to the lateral offset of sprocket 70*a* and gear 70*b*, gear 70*b* of intake cam drive assembly 70 is configured to mesh or otherwise engage with first and second exhaust sprockets 72, 74 such that rotation of gear 70*b* causes rotation of exhaust cam sprockets 72, 74. As such, the rotation of crankshaft 18 causes rotation of drive sprocket 34 and such rotation, through chain 32, drives rotation of intake cam drive assembly 70 and exhaust sprockets 72, 74, thereby causing rotation of camshafts 36, 38, 40, respectively.

During operation of engine 2, it may be desirable to vary the open and closed conditions and the timing of intake valves 44. More particularly, in certain applications and conditions of engine 2, it may be desirable to advance the opening intake valves 44 such that intake valves 44 open during a portion of the exhaust stroke of the combustion cycle. For example, when pistons 24, 26 are approaching and/or at the TDC position, it may be desirable to open intake valves 44 such that a portion of the exhaust gases, which may include unspent fuel in the form an air/fuel mixture, may flow back into the intake manifold (not shown) of engine 2. However, other applications and conditions of engine 2 may require intake valves 44 to open only during the intake stroke of the combustion cycle or at any other portion of the combustion cycle. As such, the present disclosure allows for continuously varying the opening and closing times and durations of intake valves 44.

Figure 8:
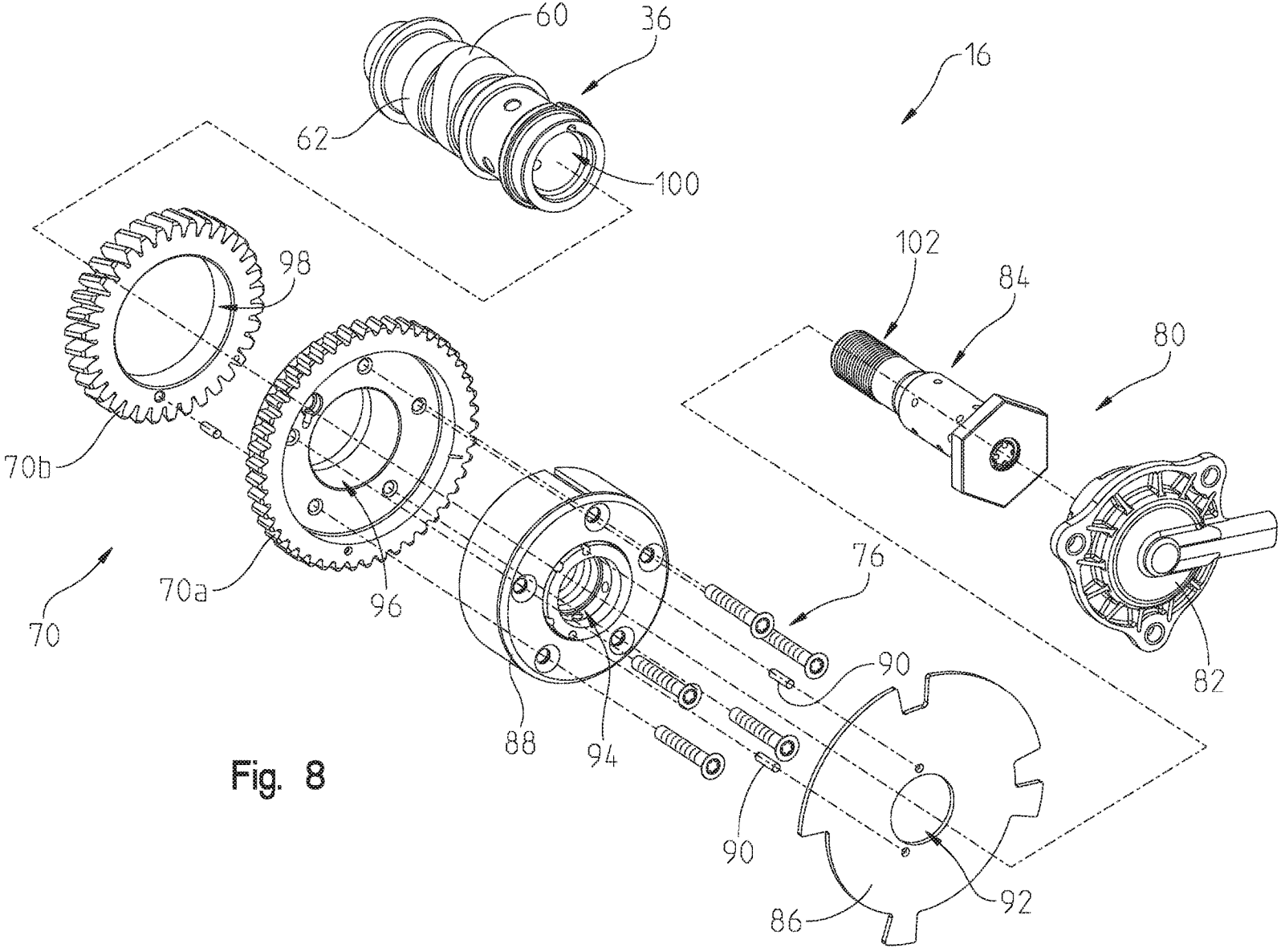
FIG. 8 is a front exploded view of the cam phaser assembly for an intake camshaft of the valve train of FIG. 3.

Referring to FIGS. 8-10, to allow for continuous variable valve timing of intake valves 44, valve train assembly 16 includes a cam phaser assembly 80. It may be appreciated that cam phaser assembly 80 is illustratively shown as a cam torque actuated phaser which may be hydraulically operated, however, electronic or any other type of phaser may be used.

Cam phaser assembly 80 includes an actuator assembly 82, for example a solenoid assembly, a phaser control valve 84, a timing wheel 86, a sensor 87, and a phaser module 88. Phaser module 88 is coupled to sprocket 70*a* of intake cam drive assembly 70 with a plurality of fasteners 76, illustratively bolts. Timing wheel 86 is positioned laterally outward of phaser module 88 and is located on phaser module 88 with dowels 90. In one embodiment, timing wheel 86 is positioned axially intermediate phaser module 88 and intake cam drive assembly 70. Sensor 87 may be electrically coupled with timing wheel 86 and/or other components of cam phaser assembly 80 but spaced apart from actuator assembly 82 and timing wheel 86.

Referring still to FIGS. 8-10, phaser control valve 84 is configured to be received through a central opening 92 of timing wheel 86, a central opening 94 of phaser module 88, a central opening 96 of sprocket 70*a*, and a central opening 98 of gear 70*b*. Phaser control valve 84 also is configured to be received through a central opening or conduit 100 of intake camshaft 36. In one embodiment, phaser control valve 84 includes external threads 102 which are threadedly coupled with internal threads (not shown) of a portion of intake camshaft 36. Phaser control valve 84 is operably coupled to actuator assembly 82. In one embodiment, actuator assembly 82 defines the laterally outermost component and surface of valve train assembly 16 and at least a portion of phaser control valve 84 extends laterally inward therefrom. Illustratively, at least a portion of cam phaser assembly 80 may be housed within cam chest 14 and, in one embodiment, actuator assembly 82 may extend outwardly from cam chest 14, as shown in FIG. 2.

In operation, and referring to FIG. 10, cam phaser assembly 80, including phaser control valve 84, may be electrically coupled to an engine control unit (not shown) and/or a vehicle control unit (not shown) to adjust the position of intake camshaft 36. Adjusting the position of intake camshaft 36 changes the centerline thereof and the lobe separation angle between intake camshaft 36 and exhaust camshafts 38, 40. In this way, the combination of cam phaser assembly 80, sprocket 70*a*, and gear 70*b* allows for independent control of intake valve timing relative to exhaust valve timing while maintaining a gear drive or ratio between intake camshaft 36 and exhaust camshafts 38, 40. In one embodiment, cam phaser assembly 80 may have a maximum authority of approximately 70°, thereby allowing for movement of the position of intake camshaft 36 approximately 0-35 camshaft angle degree ("CamAD") as rotation or operation of crankshaft 18 moves through approximately 0-70 crank angle degree ("CAD"). The position of intake camshaft 36 may be monitored by timing wheel 86 and sensor 87. Therefore, cam phaser assembly 80 may be configured to advance and/or retard the position of intake camshaft 36 relative to exhaust camshafts 38, 40 and/or crankshaft 18 to vary the opening and closing timing and conditions of intake valves 44. This variable valve timing of intake valves 44 may be used to increase fuel efficiency, control emissions output, and/or affect any other operating parameter of engine 2.

The phasing of intake camshaft 36 also may eliminate the need for a mechanical decompression system. Various decompression systems may be configured to slightly open exhaust valves 48, 52 during the compression stroke of pistons 24, 26, respectively, in order to make engine 2 easier to crank during starting (e.g., less than approximately 500 rpm). Such decompression systems may be configured to deactivate when engine 2 achieves a predetermined idle speed (e.g., greater than approximately 500 rpm). However, the present disclosure may eliminate the need for such decompression systems because, through the use of cam phaser assembly 80, intake valves 44 may be configured to open to a predetermined position during the compression stroke to allow fluids (e.g., fuel, air) within the combustion chamber to exhaust through intake valves 44 and into the intake manifold (not shown) of engine 2. The opening of intake valves 44 during the compression stroke is possible because the position of intake camshaft 36 may be adjusted by cam phaser assembly 80, as disclosed herein. It may be appreciated that exhaust valves 48, 52 also may be opened to a predetermined position during the compression stroke such that intake valves 44 and exhaust valves 48, 52 may both be in an open condition at this point during the combustion cycle when engine 2 is operating at low speeds. Once engine 2 achieves a normal operating speed, the opening timing of intake valves 44 may be further adjusted with cam phaser assembly 80 such that only exhaust valves 48, 52 are open during the compression stroke.

Referring to FIGS. 1-7, the location of cam chest 14, cam phaser assembly 80, and various components of valve train assembly 16 relative to other components of engine 2 is disclosed. It may be appreciated that, if engine 2 is configured for use on a straddle-type vehicle (e.g., a motorcycle), cam chest 14 and cam phaser assembly 80 may be located at a low position on the vehicle to prevent interference with the rider and/or any controls or components of the vehicle. Illustratively, cam chest 14, which houses valve train assembly 16 and at least a portion of cam phaser assembly 80, is positioned laterally outward of cylinders 4, 6, pushrods 42, 46, 50, and crankcase 12. More particularly, and as best shown in the top view of FIG. 6, a portion of valve train assembly 16, including sprocket 70*a*, exhaust cam sprockets 72, 74, and cam phaser assembly 80 are positioned outside of an envelope 140 defined by cylinder heads 10. In other words, and as shown in FIGS. 3-6, sprocket 70*a*, exhaust cam sprockets 72, 74, and cam phaser assembly 80 are positioned laterally outward of the lateral width defined by cylinder heads 10 (i.e., envelope 140). In one embodiment, at least actuator assembly 82, timing wheel 86, sensor 87, and phaser module 88 of cam phaser assembly 80 are positioned laterally outward of envelope 140. As shown in at least FIGS. 2 and 6, actuator assembly 82 and sensor 87 of cam phaser assembly 80 define the laterally outermost components of valve train assembly 16 and may be positioned laterally external to cam chest 14 (FIG. 2). Additionally, at least cam phaser assembly 80 is positioned outward of envelope 140 because cam phaser assembly 80 is positioned lower than cylinder heads 10 and, therefore, is outside of envelope 140 defined by cylinder heads 10.

Figure 5:
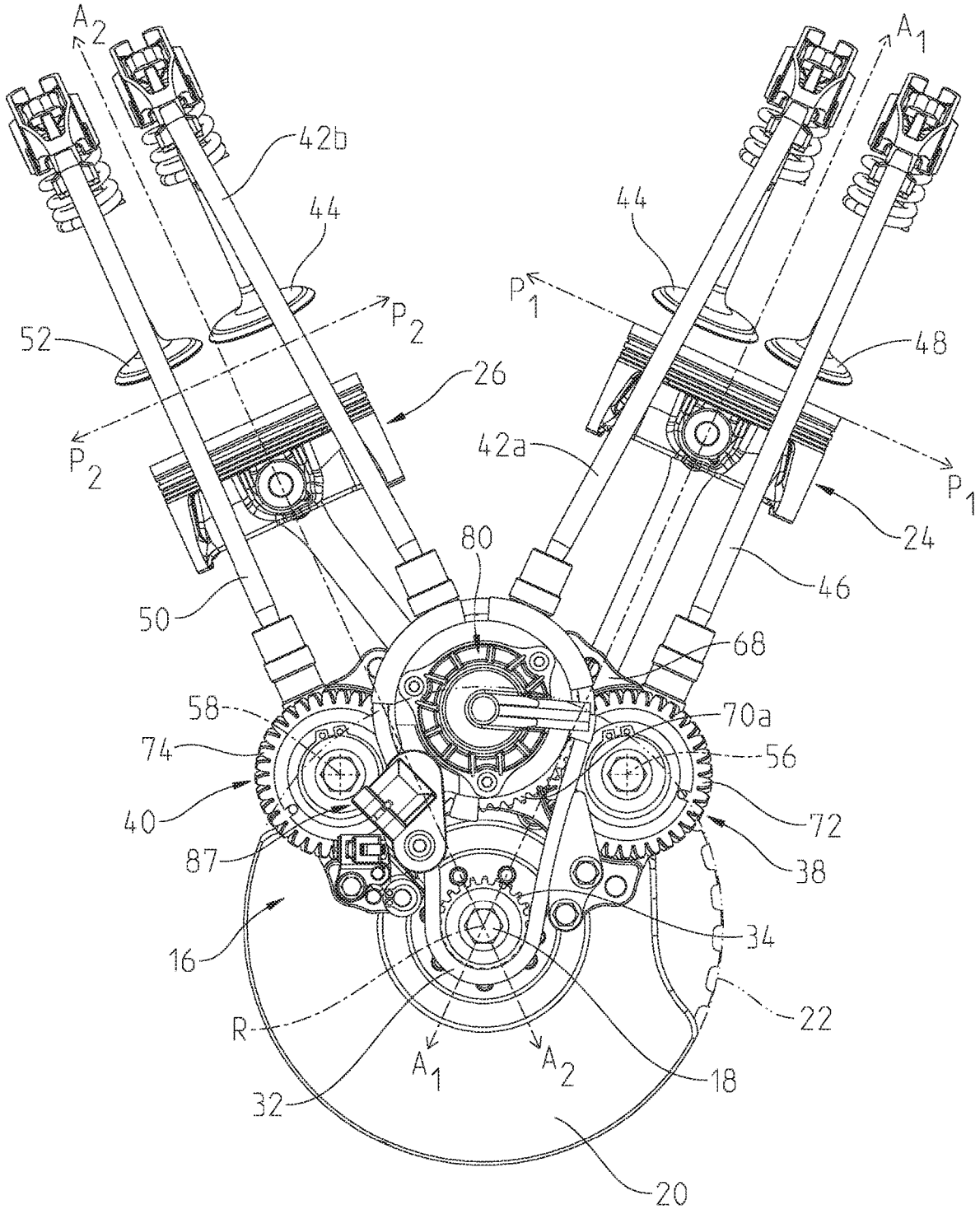
FIG. 5 is a right side view of the valve train and crankshaft of FIG. 3.
Figure 6:
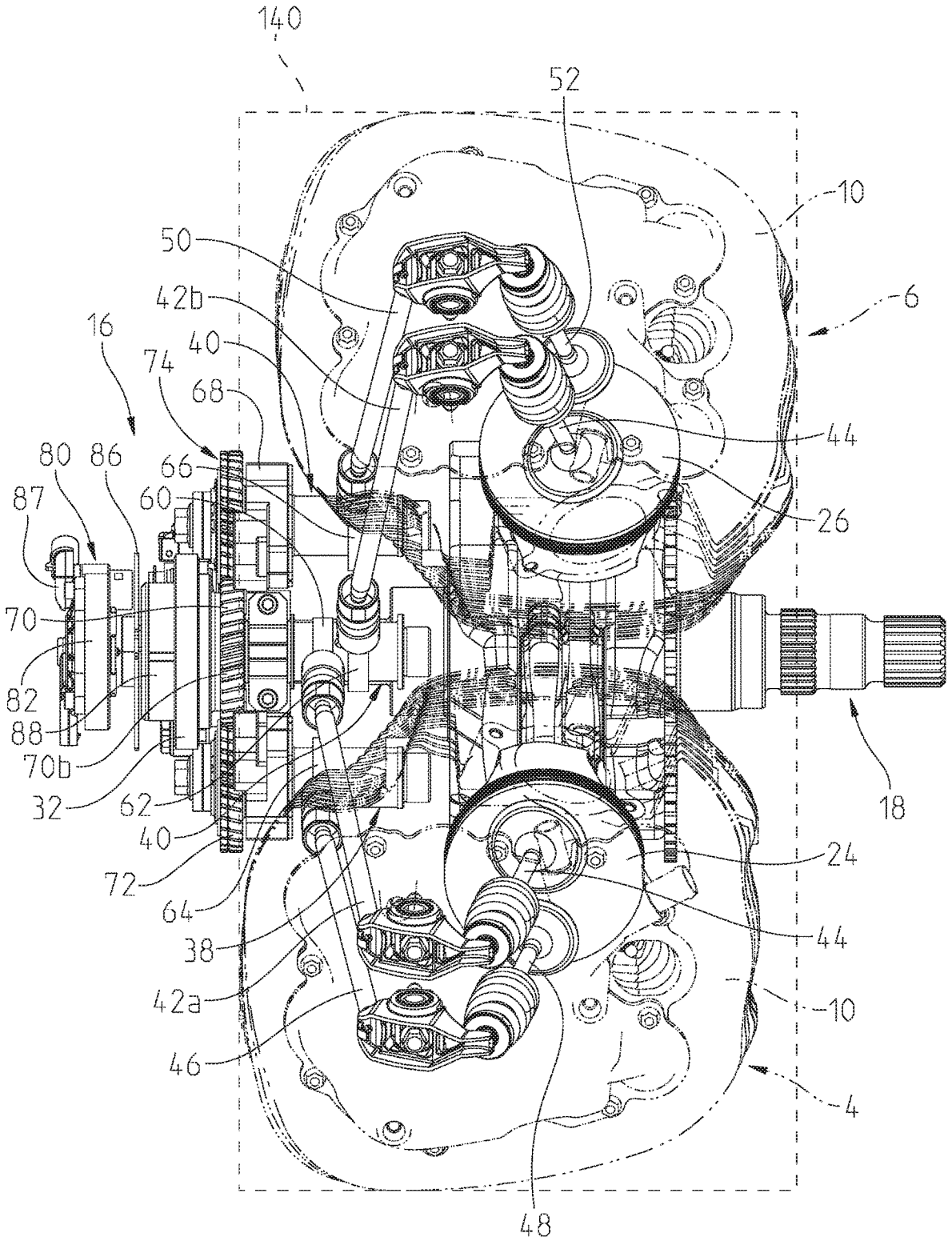
FIG. 6 is a top view of the valve train and crankshaft of FIG. 3 and including cylinder heads shown in phantom.
Figure 7:
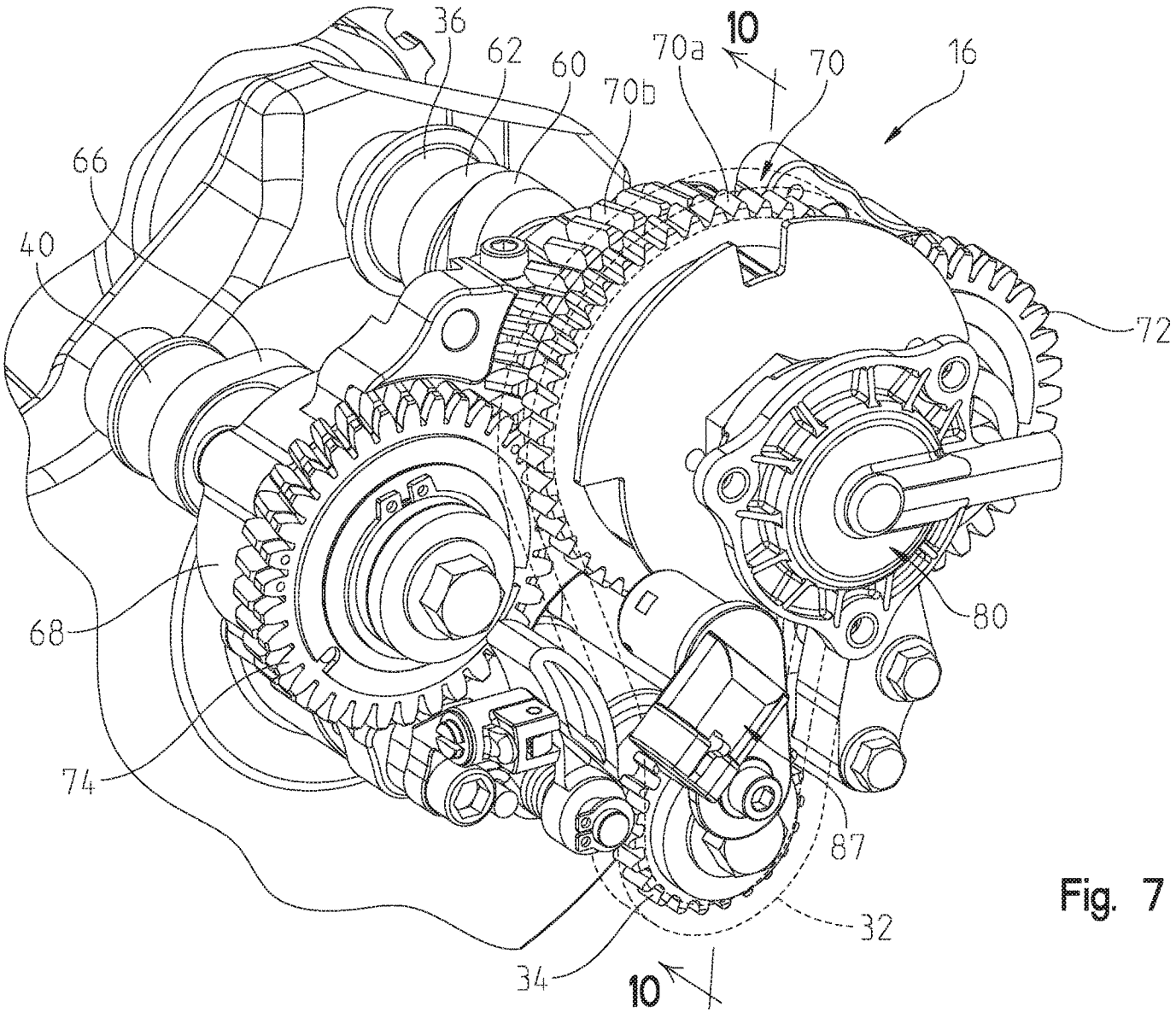
FIG. 7 is a right rear perspective view of a portion of the valve train of FIG. 3, including a cam phaser assembly.

As also shown in FIGS. 1-7, cam phaser assembly 80 is generally positioned above a portion of crankshaft 18 such that cam phaser assembly 80 is not axially aligned with crankshaft 18 but, instead, is vertically offset from crankshaft 18 and extends parallel to axis of rotation R of crankshaft 18. In this vertical position, cam phaser assembly 80 is positioned within circular envelope 22 of crankshaft 18 (FIG. 5). Cam phaser assembly 80 also is positioned longitudinally intermediate first and second cylinders 4, 6. Illustratively, cam phaser assembly 80 is positioned generally rearward of first cylinder 4 and generally forward of second cylinder 6. More particularly, cam phaser assembly 80 is positioned longitudinally intermediate first and second exhaust pushrods 46, 50.

Also, and as shown best in FIG. 5, cam phaser assembly 80 and intake camshaft 36 are positioned within a diamond-shaped envelope 142 defined by axes $A_1$ and $A_2$ of cylinders 4, 6, respectively, a first firing or fire deck plane $P_1$ defined by the TDC position of first piston 24, and a second firing or fire deck plane $P_2$ defined by the TDC position of second piston 26. Illustratively, first and second axes $A_1$, $A_2$ are defined as extending perpendicular to firing planes $P_1$, $P_2$, respectively, and through axis of rotation R. The apex of envelope 142 is positioned vertically above a portion of axis of rotation R of crankshaft 18. In this way, cam phaser assembly 80 and intake camshaft 36 may be positioned above axis of rotation R of crankshaft 18 but below firing planes $P_1$, $P_2$ of cylinders 4, 6, respectively. Additionally, this location of cam phaser assembly 80 and intake camshaft 36 is positioned longitudinally intermediate axes $A_1$ and $A_2$ of cylinders 4, 6, respectively.

Additionally, and as shown best in FIGS. 2-5, sensor 87 is positioned vertically lower than cylinders 4, 6 and is positioned vertically intermediate intake camshaft 36 and crankshaft 18. Yet, because sensor 87 is positioned laterally outward from crankcase 12 and cam chest 14, sensor 87 is not vertically aligned with intake camshaft 36 or crankshaft 18, but instead, is positioned at a vertically lower position on engine 2 than cylinders 4, 6 and intake camshaft 36 and is positioned at a vertically higher or greater position on engine 2 than crankshaft 18. Sensor 87 also is positioned in lateral or axial alignment with cam chest 14 and actuator assembly 82 in the top view of FIG. 6 such that at least a portion of sensor 87 is aligned with or overlaps a portion of cam chest 14 and actuator assembly 82 in the axial direction of intake camshaft 36 and crankshaft 18.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An engine for a two-wheeled vehicle, the engine comprising:

at least one cylinder comprising a combustion chamber and a cylinder head positioned adjacent the combustion chamber;

a crankcase coupled to the at least one cylinder and including a crankshaft;

a piston positioned within the at least one cylinder and operably coupled to the crankshaft; and a valve train operably coupled to the crankshaft and comprising:

at least one intake valve fluidly coupled to the combustion chamber;

at least one exhaust valve fluidly coupled to the combustion chamber;

at least one pushrod operably coupled to one of the at least one intake valve or the at least one exhaust valve;

an intake camshaft operably coupled to the at least one intake valve, the at least one pushrod, and the crankshaft;

an intake cam sprocket operably coupled to the intake camshaft;

an exhaust camshaft operably coupled to the at least one exhaust valve;

an exhaust cam sprocket operably coupled to the exhaust camshaft;

a cam phaser assembly operably coupled to at least one of the intake camshaft and the exhaust camshaft and positioned outside an envelope of the cylinder head; and a phase sensor electrically coupled to the cam phaser assembly, wherein the phase sensor is positioned lower than the at least one cylinder and is positioned vertically intermediate and offset from the intake camshaft and the crankshaft, and wherein the phase sensor is positioned axially outward from at least one of the intake cam sprocket and the exhaust cam sprocket.

2. The engine of claim 1, wherein the cam phaser assembly extends outwardly from the crankcase.

3. The engine of claim 1, wherein the cam phaser assembly is positioned laterally outward of the at least one pushrod.

4. The engine of claim 1, wherein the phase sensor is spaced apart from the cam phaser assembly.

5. The engine of claim 1, wherein the cam phaser assembly is operably coupled to the intake camshaft.

6. The engine of claim 1, wherein the cam phaser assembly is positioned lower than the at least one cylinder.

7. The engine of claim 6, wherein the at least one cylinder includes a first cylinder extending along a first axis and a second cylinder extending along a second axis, wherein the cam phaser assembly is positioned within an envelope defined by the first axis, the second axis, and an axis of rotation of the crankshaft.

8. The engine of claim 7, wherein the cam phaser assembly is positioned within a circular envelope defined by rotation of the crankshaft.

9. The engine of claim 1, wherein the valve train further comprises an intake drive assembly operably coupled to the intake camshaft and the intake drive assembly includes a sprocket and a gear coupled to the sprocket.

10. The engine of claim 9, wherein the sprocket is laterally offset from the gear.

11. An engine for a two-wheeled vehicle, the engine comprising:

at least one cylinder comprising a combustion chamber and a cylinder head positioned adjacent the combustion chamber;

a crankcase coupled to the at least one cylinder and including a crankshaft positioned within a crankshaft housing of the crankcase; and a valve train operably coupled to the crankshaft and comprising:

at least one intake valve fluidly coupled to the combustion chamber;

at least one exhaust valve fluidly coupled to the combustion chamber;

at least one pushrod operably coupled to one of the at least one intake valve or the at least one exhaust valve;

a cam chest operably coupled to the at least one pushrod;

a cam phaser assembly operably coupled to the cam chest, wherein the cam chest and the cam phaser assembly are positioned outward of the crankcase housing and the at least one cylinder in a top view of the engine; and a phase sensor electrically coupled to the cam phaser assembly, wherein the phase sensor axially overlaps the cam chest and the cam phase assembly in the top view of the engine, and wherein the phase sensor defines an axially outermost component of the valve train.

12. The engine of claim 11, wherein the cam phaser assembly is at a laterally outermost portion of the valve train.

13. The engine of claim 11, wherein the cam phaser assembly is laterally outward of the cam chest.

14. The engine of claim 11, wherein the valve train further comprises an intake drive assembly operably coupled to the cam chest and the intake drive assembly includes a sprocket and a gear fixed to the sprocket.

15. The engine of claim 11, wherein the at least one cylinder includes a first cylinder and a second cylinder, wherein the cam phaser assembly is vertically offset from the crankshaft and positioned longitudinally intermediate the first and second cylinders.

16. The engine of claim 15, wherein the at least one pushrod includes a first intake pushrod operably coupled to the first cylinder, a second intake pushrod operably coupled to the second cylinder, a first exhaust pushrod operably coupled to the first cylinder, and a second exhaust pushrod operably coupled to the second cylinder, wherein the cam phaser assembly is positioned longitudinally intermediate the first and second exhaust pushrods.

17. An engine for a two-wheeled vehicle, the engine comprising:

at least one cylinder comprising a combustion chamber and a cylinder head positioned adjacent the combustion chamber;

a crankcase coupled to the at least one cylinder and including a crankshaft; and a valve train operably coupled to the crankshaft and comprising:

at least one camshaft operably coupled to the crankshaft and vertically overlapping a portion of the crankshaft in an axial direction;

a drive assembly operably coupled to the at least one camshaft;

a timing wheel operably coupled to the drive assembly; and a cam phaser assembly operably coupled to the at least one camshaft and positioned outward of the crankcase, wherein the timing wheel is positioned axially intermediate the cam phaser assembly and the drive assembly.

18. The engine of claim 17, wherein the valve train further comprises a phase sensor electrically coupled to the cam phaser assembly and the timing wheel, wherein the phase sensor is positioned vertically intermediate the at least one camshaft and the crankshaft.

19. The engine of claim 18, wherein the at least one camshaft includes an intake camshaft and an exhaust camshaft, wherein the phase sensor axially overlaps the exhaust camshaft in a top view of the engine.

20. The engine of claim 17, wherein the at least one camshaft includes an intake camshaft and an exhaust camshaft, wherein the exhaust camshaft is positioned vertically intermediate the intake camshaft and the crankshaft.

21. The engine of claim 20, wherein an axis of rotation of the exhaust camshaft is positioned vertically intermediate an axis of rotation of the intake camshaft and an axis of rotation of the crankshaft.

22. An engine for a two-wheeled vehicle, the engine comprising:

a crankcase including a crankshaft configured to rotate about an axis of rotation;

a first cylinder coupled to the crankcase and having a first axis and a first piston configured to reciprocate between a first top-dead-center position and a first bottom-dead-center position, wherein the first top-dead-center position defines a first firing plane of the first piston, wherein the first axis is perpendicular to the first firing plane and extends through the axis of rotation of the crankshaft;

a first cylinder head coupled to the first cylinder;

a second cylinder coupled to the crankcase and having a second axis and a second piston configured to reciprocate between a second top-dead-center position and a second bottom-dead-center position, wherein the second top-dead-center position defines a second firing plane of the second piston, wherein the second axis is perpendicular to the second firing plane and extends through the axis of rotation of the crankshaft;

a second cylinder head coupled to the second cylinder; and a valve train operably coupled to the crankshaft and comprising:

an intake camshaft operably coupled to the crankshaft;

a first exhaust camshaft operably coupled to the first cylinder;

a second exhaust camshaft operably coupled to the second cylinder;

a drive assembly operably coupled to the at least one camshaft;

a timing wheel operably coupled to the drive assembly; and a cam phaser assembly operably coupled to the intake camshaft, wherein the intake camshaft and the cam phaser assembly are positioned within an envelope defined by the first and second firing planes and the first and second axis, wherein the first and second exhaust camshafts are positioned outside of the envelope, wherein the timing wheel is positioned axially intermediate the cam phaser assembly and the drive assembly.

23. The engine of claim 22, wherein an apex of the envelope is positioned vertically above a portion of the axis of rotation of the crankshaft.

24. The engine of claim 22, wherein the cam phaser assembly is positioned outside of a second envelope defined by the first and second cylinder heads.

25. The engine of claim 22, wherein the cam phaser assembly is one of a hydraulically-actuated cam phaser assembly, a cam-torque-actuated cam phaser assembly, or an electronically-actuated cam phaser assembly.

* * * * *